US005942483A

United States Patent [19]

Leu

[11] Patent Number: 5,942,483

[45] Date of Patent: Aug. 24, 1999

[54] HIGH MOLECULAR WEIGHT, SOLID STATE ACTIVE DETERGENT

[76] Inventor: Shiow Jiuan Freida Leu, No. 487, Noan Noan Street, Noan Noan District, Keelung City, Taiwan

[21] Appl. No.: 09/021,404

[22] Filed: Feb. 10, 1998

[51] Int. Cl.[6] ..... C11D 1/83

[52] U.S. Cl. ..... 510/326; 510/324; 510/349; 510/475; 510/441

[58] Field of Search ..... 510/324, 326, 510/349, 356, 358, 475, 441

[56] References Cited

U.S. PATENT DOCUMENTS 5,417,879 5/1995 Hall et al. ..... 252/174.17
5,668,098 9/1997 Gutierrez et al. ..... 510/350
5,686,402 11/1997 Gutierrez et al. ..... 510/361
5,750,733 5/1998 Vermeer et al. ..... 549/346
5,846,925 12/1998 Wilson et al. ..... 510/499

*Primary Examiner*—John R. Hardee
*Attorney, Agent, or Firm*—Bacon & Thomas, PLLC

[57] ABSTRACT

A high molecular weight, solid state active detergent made by mixing two pilled materials at a predetermined ratio, the detergent containing sodium lauryl sulfate, fatty alcohol polyoxyetbylene (9) [ether (AEO-9)], CMC (carboxymethyl cellulose), EDTA (ethylene diamine tetra-acetic acid), fluorescent whitening agent, sodium silicate pentahydrate ($Na_2Sio_35H_2O$), sodium carbonate ($Na_2CO_3$), E-44 (epoxy resin), polyamide resin, red iron oxide, zeolite A, and fragrance.

3 Claims, No Drawings

HIGH MOLECULAR WEIGHT, SOLID STATE ACTIVE DETERGENT

BACKGROUND OF THE INVENTION (a) Field of the Invention

The present invention relates to detergents, and more particularly to a high molecular weight, solid active detergent which is made by blending in a container two different active grained materials, that are respectively prepared by mixing high molecular weight compounds with inorganic compounds subject to a specific formula.

(b) Description of the Prior Art

ABS (alkyl benzene sulfonate), LAS (linear alkylbenzene sulfonate) and SAS (sodium alkyl sulfonate) are commonly used for making detergents. However, these materials are quite stable and not easily decomposed. When these materials are carried with waste water to rivers, lakes, etc., they cause severe pollution. It has been frequently reported that using detergent causes skin irritation, lowering of blood cell index, and blood disease in women. There are specialists who reported ABS as a carcinogen. When using a synthetic detergent to wash cloths in a washing machine, a certain amount of detergent residue that is not dissolved will be left and carried off with waste water. This amount of detergent residue is a waste of material, and will cause pollution to the environment. Further, because conventional synthetic detergents are bulky, synthetic detergent manufacturers and suppliers have to invest a lot of money in material packing, transportation and storage facilities. In recent years, certain people advocate using inorganic cleaning materials (for example, silicate) to clean things. However, these inorganic cleaning materials will not be widely accepted by consumers because of their low cleaning effect. Furthermore, in order to achieve a better cleaning effect, these inorganic cleaning materials must be combined with a synthetic detergent at a ratio of about three parts of inorganic cleaning material and one part of synthetic detergent.

SUMMARY OF THE INVENTION

The present invention provides a high molecular weight, solid state active detergent which eliminates the aforesaid problems. According to the present invention, the high molecular weight, solid state active detergent is made by mixing two prilled materials at a predetermined ratio, the detergent containing sodium lauryl sulfate, fatty alcohol polyoxyethylene (9) [ether (AEO-9)], CMC (carboxymethyl cellulose), EDTA (ethylene diamine tetra-acetic acid), fluorescent whitening agent, sodium silicate pentahydrate ($Na_2Sio_35H_2O$), sodium carbonate ($Na_2CO_3$), E-44 a copolymer of bisphenol A and epichlorohydrin, polyamide resin, red iron oxide, zeolite A, and fragrance. When in use, the detergent is put in a perforated container dipped in water in the washing machine. The detergent contains no chemical elements that violate the environment. Because the detergent is not bulky, it requires less delivery and storage space. Further, the detergent can be repeatedly used.

DETAILED DESCRIPTION OF THE PREFERRED EMBODIMENTS

A high molecular weight, solid state active detergent in accordance with a first embodiment of the present invention comprises sodium lauryl sulfate, fatty alcohol polyoxyethylene (9) [ether (AEO-9)], CMC (carboxymethyl cellulose), EDTA (ethylene diamine tetra-acetic acid), fluorescent whitening agent, sodium silicate pentahydrate ($Na_2Sio_35H_2O$), sodium carbonate ($Na_2CO_3$), E-44 (epoxy resin), polyamide resin, red iron oxide, zeolite A, and fragrance.

The detergent according to the first embodiment of the present invention is made by blending a first material and a second material in an open container. The first material comprises by weight (1) sodium lauryl sulfate 10–90%, (2) fatty alcohol polyoxyethylene (9) [ether (AEO-9)] 1–17%, (3) CMC (carboxymethyl cellulose) 0.01–5%, (4) EDTA (ethylene diamine tetra-acetic acid) 0.01–5%, (5) fluorescent whitening agent 0.01–5%, (6) sodium silicate pentahydrate ($Na_2Sio_35H_2O$) 0.5–15%, (7) sodium carbonate ($Na_2CO_3$) 5–50%, (8) E-44 (epoxy resin) 0.5–20%, (9) polyamide resin 0.5–20%, (10) red iron oxide 0.01–5%, (11) zeolite A 0.01–30%, and (12) fragrance 0.5–10%. The second material is comprised of by weight (1) sodium lauryl sulfate 8–80%, (2) fatty alcohol polyoxyethylene (9) [ether (AEO-9)] 1–17%, (3) CMC (carboxymethyl cellulose) 0.01–5%, (4) EDTA (ethylene diamine tetra-acetic acid) 0.01–5%, (5) fluorescent whitening agent 0.01–5%, (6) sodium silicate pentahydrate ($Na_2Sio_35H_2O$) 0.5–15%, (7) sodium carbonate ($Na_2CO_3$) 5–50%, (8) E-44 (epoxy resin) 0.5–20%, (9) polyamide resin 0.5–20%, (10) zeolite A 0.01–30% (11) fragrance 0.5–10%. The fabrication procedure of the aforesaid first and second materials includes the steps of:

i) mixing CMC (carboxylmethyl cellulose), EDTA (ethylene diamine tetra-acetic acid), fluorescent whitening agent, sodium silicate pentahydrate ($Na_2Sio_35H_2O$) and sodium carbonate ($Na_2CO_3$) in a mixing container according to the desired weight ratio, then adding fatty alcohol polyoxyethylene (9) [ether (AEO-9)] to the mixture thus obtained and mixing the mixture well, and then adding sodium lauryl sulfate to the mixture thus obtained and mixing the mixture well;

ii) mixing E-44 epoxy resin, polyamide resin and red iron oxide in a mixing container (red iron oxide is eliminated from the mixture when preparing the second material), then adding the mixture thus obtained to the mixture obtained from step i);

iii) processing the mixture thus obtained from step ii) into smooth material strips by a press;

iv) drying the smooth material strips thus obtained by putting the smooth material strips in an air-conditioned room controlled at 25° C.;

v) putting the hardened smooth material strips thus obtained in a prilling machine and then processing into small balls;

vi) putting the small balls thus obtained in an oven and heating to a temperature of about within 70° C.–80° C., and then removing the small balls out of the oven when the small balls are dried and hardened; and vii) mixing fragrance (about 80 g) with talcum powder (or calcium carbonate), then spraying the powder mixture over the small balls obtained from step vi), and then putting the small balls in a container.

When the first material and the second material are obtained subject to the aforesaid procedure, they are mixed at a ratio of 2:1 when packaging. The high molecular weight, solid active detergent can be repeatedly used without adding other synthetic detergent.

What the invention claimed is:

1. An active detergent made by blending a first material and a second material in a container, wherein the first material comprises, by weight %, (1) sodium lauryl sulfate, 10–90%, (2) fatty alcohol polyoxyethylene, 1–17%, (3) carboxymethyl cellulose, 0.01–5%, (4) ethylene diamine tetra-acetic acid, 0.01–5%, (5) fluorescent whitening agent 0.01–5%, (6) sodium silicate pentahydrate 0.5–15%, (7) sodium carbonate 5–50%, (8) a copolymer of bisphenol A and epichlorohydrin 0.5–20%, (9) polyamide resin 0.5–20%, (10) red iron oxide 0.01–5%, (11) zeolite A 0.01–30%, and (12) fragrance 0.5–10%, the second material comprises by weight%, (1) sodium lauryl sulfate, 8–80%, (2) fatty alcohol polyoxyethylene, 1–17% (3) carboxymethyl cellulose 0.01–5%, (4) ethylene diamine tetra-acetic acid 0.01–5%, (5) fluorescent whitening agent 0.01–5%, (6) sodium silicate pentahydrate, 0.5–15%, (7) sodium carbonate, 5–50% (8) a copolymer of bisphenol A and epichlorohydrin, 0.5–20% (9) polyamide resin 0.5–20% (10) zeolite A 0.01–30%, and (11) fragrance 0.5–10%.

2. The composition of claim 1, wherein the copolymer is composed of bisphenol A and epichlorohydrin of 0.41–0.47 mol/100 g.

3. A method of manufacturing the active detergent as claimed in claim 1, which comprises the step of making the first material and the second material for the active detergent and the step of mixing the first material with the second material in a container in a ratio of 2:1, the procedure for making the first material comprising the steps of:

i) mixing carboxylmethyl cellulose, ethylene diamine tetra-acetic acid, fluorescent whitening agent, sodium silicate pentahydrate and sodium carbonate in a mixing container according to the designated weight ratio, then adding fatty alcohol polyoxyethylene to the mixture thus obtained and mixing the mixture well, and then adding sodium lauryl sulfonate to the mixture thus obtained and mixing the mixture will;

ii) mixing copolymer, polyamide resin and red iron oxide in a mixing container, then adding the mixture thus obtained to the mixture obtained from step I), iii) processing the mixture thus obtained from step ii) into smooth material strips by a press;

iv) drying the smooth material strips thus obtained by putting the smooth material strips in an air-conditioned room controlled at 25° C.;

v) putting the hardened smooth material strips thus obtained in a prill machine and then processing into small balls;

vi) putting the small balls thus obtained in an oven and heating to a temperature of from about 70° C. to 80° C., and then removing the small balls out of the oven when the small balls are dried and hardened, and vii) mixing fragrance with talcum powder calcium carbonate, and then spraying the powder mixture over the small balls obtained from step vi) and then putting the small balls in a container; the procedure for making the second material comprises i) mixing carboxylmethy cellulose, ethylene diamine tetra-acetic acid, fluorescent whitening agent, sodium silicate pentahydrate and calcium carbonate in a mixing container according to the desired weight ratio, then adding fatty alcohol polyoxyethylene to the mixture thus obtained and mixing the mixture well, and then adding sodium lauryl sulfonate to the mixture thus obtained and mixing the mixture well;

ii) mixing copolymer and polyamide resin in a mixing container, then adding the mixture thus obtained to the mixture obtained from step I);

ii) processing the mixture thus obtained from step ii) into smooth material strips by a press;

iv) drying the smooth material strips thus obtained by putting the smooth material in an air-conditioned room controlled at 25° C.;

v) putting the hardened smooth material strips thus obtained in a prill machine and then processed into small balls;

vi) putting the small balls thus obtained in an oven and heating at a temperature of from about 79° C. to 80° C., and then removing the small balls out of the oven when the small balls are dried and hardened; and vii) mixing fragrance with talcum powder or calcium carbonate, then spraying the powder mixture over the small balls obtained from step vi) and then putting the small balls in a container.

* * * * *